US005386598A

United States Patent [19]

Mersmann

[11] Patent Number: 5,386,598

[45] Date of Patent: Feb. 7, 1995

[54] WHIRLPOOL BATHTUB WITH DEVICES FOR GENERATING JETS OF WATER AND/OR AIR

[75] Inventor: Heinz-Werner Mersmann, Ahlen, Germany

[73] Assignee: Franz Kaldewei GmbH & Co., Germany

[21] Appl. No.: 50,139

[22] PCT Filed: Jul. 25, 1992

[86] PCT No.: PCT/EP92/01694

§ 371 Date: May 3, 1993

§ 102(e) Date: May 3, 1993

[87] PCT Pub. No.: WO93/04656

PCT Pub. Date: Mar. 18, 1993

[30] Foreign Application Priority Data

Sep. 3, 1991 [DE] Germany ..... 4129217

[51] Int. Cl.[6] ..... A61H 33/02

[52] U.S. Cl. ..... 4/541.4; 4/541.6

[58] Field of Search ..... 4/541.3, 541.4, 541.6, 4/492

[56] References Cited

U.S. PATENT DOCUMENTS

| | | | |
|---|---|---|---|
| 2,336,127 | 12/1943 | Rocke | 4/541.4 X |
| 3,961,382 | 6/1976 | Peterson, Jr. | 4/541.4 |
| 4,127,117 | 11/1978 | Peterson, Jr. | 4/541.4 X |
| 4,520,514 | 6/1985 | Johnson | 4/490 |
| 4,559,653 | 12/1985 | Mathews | 4/541.6 |
| 4,561,133 | 12/1985 | Laing | 4/491 |
| 4,665,572 | 5/1987 | Davidson et al. | 4/492 |
| 4,813,086 | 3/1989 | Henkin et al. | 4/541.6 |
| 4,829,607 | 5/1989 | Huse | 4/541.1 |
| 4,853,987 | 8/1989 | Jaworski | 4/541.6 |
| 4,907,304 | 3/1990 | Davidson et al. | 4/488 |
| 5,031,255 | 7/1991 | Hilger et al. | 4/541.4 |
| 5,056,168 | 10/1991 | Mersmann | 4/541.6 |
| 5,063,620 | 11/1991 | Mersmann | 4/541.6 |
| 5,173,973 | 12/1992 | Mersmann | 4/541.1 |

FOREIGN PATENT DOCUMENTS

| | | |
|---|---|---|
| 0209646 | 1/1987 | European Pat. Off. . |
| 0286941 | 10/1988 | European Pat. Off. . |
| 0421520 | 4/1991 | European Pat. Off. . |
| 1134038 | 4/1957 | France . |
| 1566497 | 10/1970 | Germany . |
| 2209507 | 9/1973 | Germany . |

(List continued on next page.)

OTHER PUBLICATIONS

Prospectus: Hugo Lahme GmbH, 6 pgs., Feb. 1978.

*Primary Examiner*—Robert M. Fetsuga

*Attorney, Agent, or Firm*—Speckman, Pauley & Fejer

[57] ABSTRACT

A whirlpool bathtub having devices for generating jets of water and/or air which can be supplied to the tub interior at a plurality of places of the tub wall. An individual device, capable of being powered for generating a water and/or air jet, is installed in an opening in the tub wall and is charged with propulsive power from the outside of the tub. Each device has a pump housing with a pump chamber in which an impeller wheel is disposed on a rotatably seated drive shaft extending perpendicularly to the tub wall. The pump chamber is covered towards the tub interior with a triangular nozzle screen. The impeller wheel aspirates water axially from the tub interior through centered aspiration openings of the nozzle screen and returns it through at least one conduit originating in the pump chamber back into the tub interior. The conduit starts at the portion of the pump chamber which encloses the impeller wheel around its periphery. The impeller wheel has radially directed feed conduits extending from the axial aspiration opening. The part of the pump chamber having the conduit is embodied as a separate adjustment part, which is rotatable to at least a limited degree with respect to a housing base part disposed, fixed against relative rotation, in an opening in the tub wall and the conduit itself forms a jet outlet opening.

24 Claims, 1 Drawing Sheet

FOREIGN PATENT DOCUMENTS

| | | |
|---|---|---|
| 2319902 | 11/1974 | Germany . |
| 2408270 | 8/1975 | Germany . |
| 2417708 | 10/1975 | Germany . |
| 3720637 | 6/1978 | Germany . |
| 2713233 | 10/1978 | Germany . |
| 2919313 | 11/1980 | Germany . |
| 3110151 | 9/1982 | Germany . |
| 3334010 | 4/1985 | Germany . |
| 3507472 | 9/1986 | Germany . |
| 8625515 | 12/1986 | Germany . |
| 3640252 | 6/1988 | Germany . |
| 8804977 | 6/1988 | Germany . |
| 3703273 | 8/1988 | Germany . |
| 3738543 | 8/1988 | Germany . |
| 3716683 | 12/1988 | Germany . |
| 3800400 | 2/1989 | Germany . |
| 3800401 | 4/1989 | Germany . |
| 3812519 | 5/1989 | Germany . |
| 0492410 | 3/1954 | Italy . |
| 0532405 | 8/1955 | Italy . |
| 8802541 | 8/1989 | Netherlands . |
| 2215599 | 9/1989 | United Kingdom . |
| 8902263 | 3/1989 | WIPO . |
| 8906120 | 7/1989 | WIPO . |

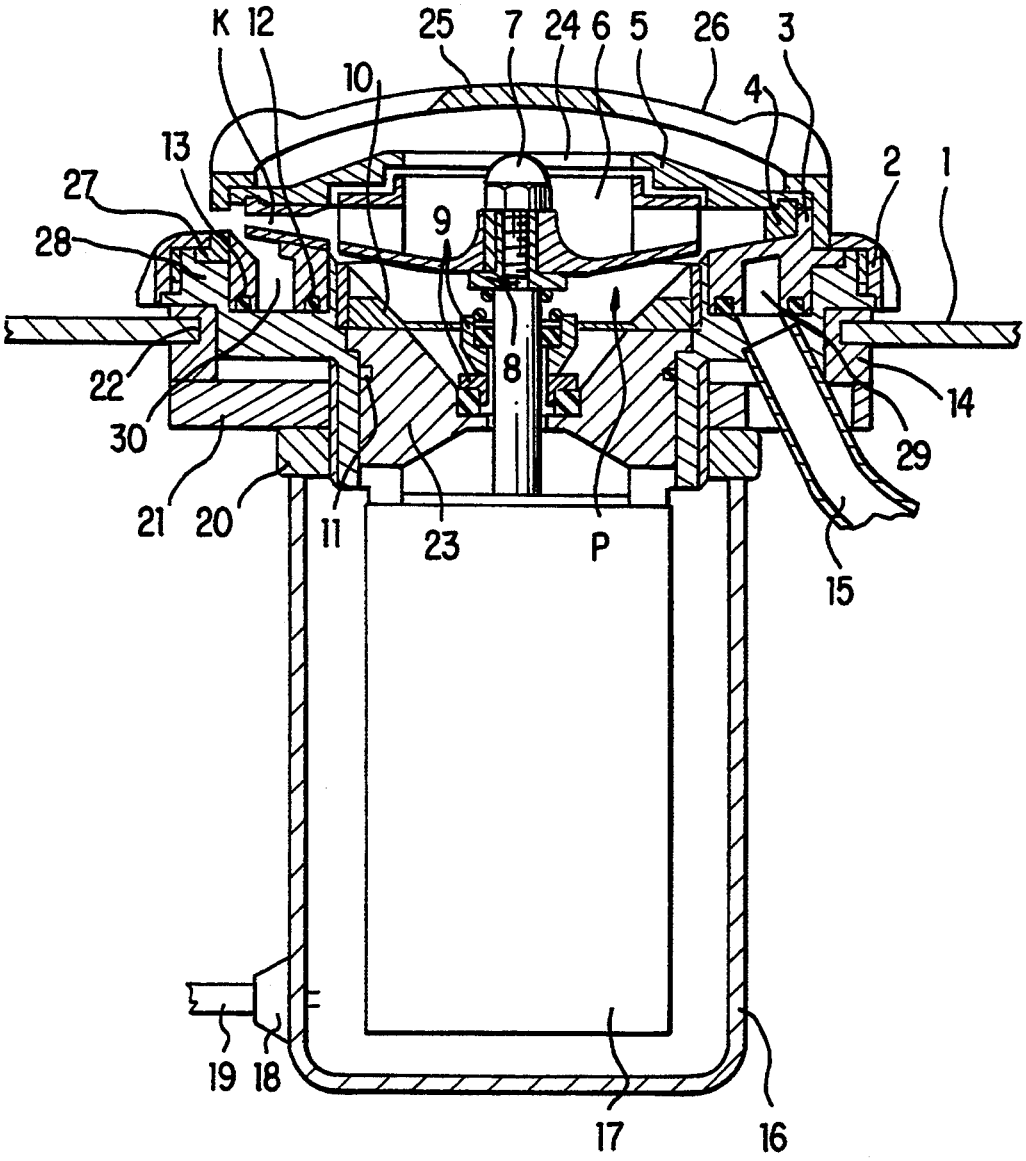
K
12
25
7
24
6
5
26
3
10
4
13
2
1
27
9
28
8
22
14
30
29
21
20
11
23
P
15
19
18
17
16

WHIRLPOOL BATHTUB WITH DEVICES FOR GENERATING JETS OF WATER AND/OR AIR

BACKGROUND OF THE INVENTION

1. Field of the Invention

This invention relates to a whirlpool bathtub having devices for generating jets of water and/or air which can be supplied to the tub interior at a plurality of places of the tub wall. Each individual device, capable of being powered for generating a water and/or air jet, is installed in an opening in the tub wall and is charged with propulsive power from the outside of the tub. Each device has a pump housing with a pump chamber in which an impeller wheel is disposed on a rotatably seated drive shaft extending perpendicularly to the tub wall. The pump chamber is covered towards the tub interior with a triangular nozzle screen. The impeller wheel aspirates water axially from the tub interior through centered aspiration openings of the nozzle screen and returns it through at least one conduit originating in the pump chamber back into the tub interior. The conduit, or conduits, starts at the portion of the pump chamber which encloses the impeller wheel around its periphery. The impeller wheel has radially directed feed conduits extending from the axial aspiration opening.

2. Description of the Prior Art

A whirlpool bathtub of this type is disclosed by German Letters Patent DE-PS 38 12 519 in which the conduit, or conduits, extends from the pump chamber and is disposed in the nozzle screen which encloses the impeller wheel around its periphery and forms a portion of the pump chamber. For admixing air to the water jet, air conduits of the pump housing terminate in the conduit of the nozzle screen. Thus, the jet openings of the nozzle screen are always in the same place so that the jet cannot be adjusted and introduced into the tub interior in a different direction. In addition, it is necessary, during the installation of the device in the opening of the bathtub, to assure that the pump housing is correctly positioned for the desired direction of the jet and the connection of the nozzle screen.

It is also known for obtaining different jet patterns to use devices with whirlpool bathtubs of this type having different nozzle screens which enclose the periphery of the impeller wheel of the pump and are provided with a different conduit (or conduits), as disclosed by German Letters Patent DE-PS 38 00 400. However, in this case, the direction of the emitted jet (or the emitted jets) remains the same because all nozzle screens are connected to the pump housing in the same predetermined position.

SUMMARY OF THE INVENTION

It is an object of this invention to provide a device for a whirlpool bathtub of the above mentioned type in which the installation of the device into the opening of the bathtub is easier and simpler, and where the direction of the jet emission can be changed in a simple manner.

This object is attained by a device in accordance with one embodiment of this invention comprising a pump chamber having the conduit as a separate adjustment part rotatable in at least a limited way with respect to a housing base part fixed secure against twisting in the opening of the tub wall. The conduit itself forms a jet outlet opening.

As a result, installation of the pump housing with the pump is no longer critical because it is not necessary to maintain a certain angular position. The adjustment part, which encloses the impeller wheel, can be freely turned and, because it has the conduit and itself is the jet opening, a simple change of the jet direction is possible.

The adjustment part is disposed between the housing base part of the pump housing and the nozzle screen, the nozzle screen having only a centered aspiration opening.

In accordance with one embodiment of this invention, the pump chamber widens in the direction towards the tub interior and the conduit is directed towards the tub bottom and extends parallel to the tub wall. Consequently, the device can be completely emptied automatically when the water is let out of the tub interior.

In accordance with another embodiment of this invention, the rotary movement of the adjustment part on the housing base part is limited such that in the end positions, the pump chamber can be completely emptied through the conduit towards the tub interior.

In accordance with another embodiment of this invention, the adjustment of the adjustment part is facilitated where the adjustment part is connected fixed against relative rotation to the nozzle screen and can be rotated together with it, and where the nozzle screen has a cutout in the area of the conduit. The cutout in the nozzle screen permits the unhampered exit of the jet (or jets).

In accordance with yet another embodiment of this invention, the adjustment part and the nozzle screen are connected fixed against relative rotation to a cover having a bearing collar, which is maintained by a fastening ring freely rotatable in a receiver ring fixed in the opening of the tub wall. The cover is cut out in the area of the conduit. Adjustment of the adjustment part is then provided by way of the cover. In accordance with one embodiment of this invention, the cover is closed in front of the centered aspiration opening of the nozzle screen and provided with radially oriented slits outside of this closed area, providing increased protection against the drawing in of hair.

In accordance with yet another embodiment of this invention, admixture of air to the emitted water jet is provided where an additional housing ring is disposed between the adjustment part and the housing base part. The additional housing ring is connected fixed against relative rotation to the adjustment part and is rotatably supported by seal rings on the receiver ring. The housing base part is inserted into the receiver ring and maintained therein by a screw ring. The housing ring has an annular groove facing the receiver ring, which is bordered by the seal rings. An air supply line disposed on the receiver ring terminates in the annular groove which makes a transition into outlet openings in the area of the conduits. In this case, compressed air from a blower can be supplied through the air supply line. In accordance with another embodiment, the outlet openings of the annular groove are embodied as Venturi openings. In accordance with this embodiment, the annular groove only needs to communicate with the ambient air above the highest water level in the bathtub. So that the housing ring is adjusted together with the adjustment part, it is provided that the housing ring is also connected fixed against relative rotation to the adjustment part.

For the rotational seating of the adjustment part, the fastening ring is screwed to the receiver ring and extends over the bearing collar of the cover. The bearing collar of the cover is supported on the receiver ring and is freely rotatable in the receiver comprising the fastening ring and receiver ring. Because the adjustment part, the housing ring and the nozzle screen form a unit in which they are fixed against relative rotation, the direction of the jet is changed solely by turning the cover. In the course of turning the cover, the cutouts in the cover and the nozzle screen remain assigned to the conduit of the adjustment part, so that the jet can reach the tub interior unhindered.

The unit, which is fixed against relative rotation, is simply obtained where the interior thread of the cover is screwed to an exterior thread of the housing ring, and the cover and the housing ring constitute a receptacle in which the nozzle screen and the adjustment part are maintained clamped and secure against relative rotation.

So that the unit consisting of cover, nozzle screen, adjustment part and housing ring can be easily removed for cleaning, the housing ring has an inner receptacle, the diameter of which is larger than the outer diameter of the impeller wheel.

BRIEF DESCRIPTION OF THE DRAWING

This invention will be described in detail in conjunction with the drawing, wherein:

The single drawing figure shows a cross-sectional side view of a device to be installed in an opening of a bathtub in accordance with one embodiment of this invention.

DESCRIPTION OF PREFERRED EMBODIMENTS

A portion of a tub wall 1 having opening 22 of a bathtub, into which a plurality of devices in accordance with this invention are to be installed, is shown in the FIGURE. A seal ring 14, U-shaped in cross section, is inserted into opening 22 and covers the edge of the opening 22 on both sides of the tub wall 1. A receiver ring 28, which extends over the seal ring 14 with a fastening flange, not identified in detail, and which extends through the opening 22 with a sleeve-like collar having an exterior thread, also not identified in detail, is inserted into the opening 22 from the direction of the tub interior (from the left in the drawing). A disk 21 is pushed on the sleeve-like collar of the receiver ring 28 and is supported on the seal ring 14 and clamped by a nut 20, screwed on the exterior thread of the sleeve-like collar, against the seal ring 14. In this way, the receiver ring 28 is tightly fixed in the opening 22 of the tub wall 1. A motor cup 16 is fastened to the nut 20, and forms a cover for a pump motor 17. This pump motor 17 is seated with its drive shaft in a housing base part 23 of a pump chamber P. The drive shaft is rotatable in axial face seals 9 which are sealed towards the drive shaft and the housing base part 23 by seal rings. The housing base part 23 is supported by a collar on a step of the receiver ring 28 and is fixed in it by a screw ring 10. In this case, a seal ring 11 seals the peripheral transition from the housing base part 23 to the receiver ring 28. A rotor wheel 6 is fastened, fixed against relative rotation, on the drive shaft of the pump motor by a cap nut 7 and a fastening sleeve 8. This rotor wheel 6 has a centered aspiration opening and adjoining radially oriented feed conduits. A housing ring 3 is supported on the front of the receiver ring 28. An annular groove 29 is formed in the side of the housing ring 3 facing the receiver ring 28 and is enclosed and sealed by two seal rings 12 and 13. The receiver ring 28 has a connector for an air supply line 15, which connector is in communication with the annular groove 29 of the housing ring 3. In this case, the angular position of the receiver ring 28 with respect to the housing ring 3 does not matter; the connector of the air supply line 15 always terminates in the annular groove 29 of the housing ring 3. The fastening flange of the receiver ring 28 has an exterior thread on which a fastening ring 2 with an interior thread can be screwed. This fastening ring 2 encloses a bearing collar 27 of a cover 25 and, together with the receiver ring 28, forms a receptacle in which the bearing collar 27 of the cover 25 is freely rotatable. The cover 25 is screwed by an interior thread on an exterior thread of the housing ring 3. The cover 25 and the housing ring 3 constitute an annular receptacle for an adjustment part 4 and a nozzle screen 5. The nozzle screen 5 and the adjustment part 4 complete the pump chamber P, which is closed off at the side toward the motor by the housing ring 3, the screw ring 10 and the housing base part 23. The adjustment part 4 and the nozzle screen 5 are clamped between the cover 25 and the housing ring 3 when the cover 25 is screwed onto the housing ring 3. In this way, the cover 25, the nozzle screen 5, the adjustment part 4 and the housing ring 3 form a fixed unit which is freely rotatable in the annular receptacle formed by the fastening ring 2 and the receiver ring 28 and receiving the bearing collar 27 of the cover 25.

The adjustment part 4 encircles the periphery of the impeller wheel 6 and forms at least one radially directed conduit K which constitutes a jet opening. The nozzle screen 5 and the cover 25 are cut out in the area of each of said jet openings, so that each of the jets can reach the tub interior unhindered. The unit comprising nozzle screen 5, adjustment part 4 and housing ring 3 is adjusted by turning the cover 25 so that the direction of each of the emitted jets is changed. In principle, the unit can be freely turned around 360° in both directions. However, if it is desired that the device, that is the pump chamber P, is always completely emptied, the turning of the unit must be limited such that, in the final positions of the unit, emptying is still possible through a downwardly directed conduit K. In accordance with one embodiment of this invention, a plurality of conduits K are disposed so as to be distributed over an appropriate area of the periphery of the adjustment part 4.

The annular groove 29 of the housing ring 3 makes a transition into outlet openings 30 in the area of the conduits K in order to admix air to the emitted water jets. In accordance with one embodiment of this invention, this air is supplied as compressed air of a blower through the air supply line 15. In accordance with another embodiment of this invention, the outlet openings 30 are embodied as Venturi openings. In this case, the air supply line 15 is only open to ambient air above the maximum water level of the bathtub so as to prevent the flow-off of water through this route.

The cover 25 extends with a closed centered area over the centered aspiration opening 24 of the nozzle screen 5 and the impeller wheel 6 and has radially directed slits 24 extending from this area. As a result, the aspiration of hair of the user is prevented and a required hair interception test is met.

The pump motor 17 is supplied with electrical drive energy through a supply cable 19 which is introduced into the motor cup 16 through a cable inlet 18 and is connected to the pump motor 17.

The unit comprising the nozzle screen 5, adjustment part 4 and housing ring 3 can be removed by undoing the fastening ring 2 and can be cleaned. In this regard, it is important that the housing ring 3 has an inner receptacle having a diameter which is a little larger than the outer diameter of the impeller wheel 6. By undoing the screw ring 10, it is also easily possible to replace the pump with the pump motor 17, impeller wheel 6 and housing base part 23.

What is claimed is:

1. In a whirlpool bathtub having a plurality of devices for generating a plurality of jets of at least one of water and air which are supplied to the tub interior at a plurality of places of the tub wall, one of said devices powered for generating said jet being disposed at each of said plurality of places and being fixedly mounted by a base part in an opening in the tub wall and charged with propulsive power from the outside of the tub, each of said devices having a pump housing with a pump chamber, an impeller wheel disposed in said pump chamber on a rotatable seated drive shaft extending perpendicularly to the tub wall, the pump chamber covered towards the tub interior with a nozzle screen, the impeller wheel aspirating water axially from the tub interior through at least one centered aspiration opening of the nozzle screen and returning it through at least one return conduit originating in the pump chamber into the tub interior, said at least one return conduit extending from a portion of the pump chamber which encloses the periphery of the impeller wheel, and the impeller wheel having at least one radially directed feed conduit extending from the axial aspiration opening, the improvement comprising:

said portion of the pump chamber (P) forming said at least one return conduit (K) comprising a separate adjustment part (4) rotatable with respect to the housing base part (23), to allow adjustment of the orientation of the return conduit, and said at least one return conduit (K) itself forming a jet outlet opening.

2. In a whirlpool bathtub in accordance with claim 1, wherein the separate adjustment part (4) is disposed between the housing base part (23) and the nozzle screen (5), said nozzle screen (5) forming a centered aspiration opening (24).

3. In a whirlpool bathtub in accordance with claim 2, wherein the pump chamber (P) widens in a direction towards the tub interior, and said at least one return conduit (K) is directed towards the tub bottom and extends parallel to the tub wall (1).

4. In a whirlpool bathtub in accordance with claim 3, wherein the rotary movement of the separate adjustment part (4) on the housing base part (23) is limited such that, in an end position, the pump chamber (P) is completely emptied through said at least one return conduit (K) towards the tub interior.

5. In a whirlpool bathtub in accordance with claim 4, wherein the separate adjustment part (4) is connected, fixed against relative rotation, to said nozzle screen (5) and is rotated together with it, and the nozzle screen (5) forms a cutout in the area of said at least one return conduit (K).

6. In a whirlpool bathtub in accordance with claim 5, wherein the separate adjustment part (4) and said nozzle screen (5) are connected, fixed against relative rotation, to a cover (25) having a bearing collar (27), which is maintained by a fastening ring (2) freely rotatable in a receiver ring (28) fixed in the opening (22) of the tub wall (1), and the cover (25) forms a cut out in the area of said at least one return conduit (K).

7. In a whirlpool bathtub in accordance with claim 6, wherein the cover (25) is closed in front of said centered aspiration opening (24) of the nozzle screen (5) and forms a plurality of radially oriented slits (26) outside of said closed area.

8. In a whirlpool bathtub in accordance with claim 7, wherein a housing ring (3) is disposed between the separate adjustment part (4) and the housing base part (23), said housing ring (3) connected, fixed against relative rotation, to the separate adjustment part (4) and rotatably supported by a plurality of seal rings (12, 13) on the receiver ring (28), and the housing base part (23) is inserted into the receiver ring (28) and maintained therein by a screw ring (10).

9. In a whirlpool bathtub in accordance with claim 8, wherein the housing ring (3) defines an annular groove (29) facing the receiver ring (28), which is bordered by the seal rings (12, 13), an air supply line (15) disposed on the receiver ring (28) terminates in the annular groove (29), and the annular groove (29) makes a transition into an outlet opening (30) in the area of said at least one return conduit (K).

10. In a whirlpool bathtub in accordance with claim 9, wherein the fastening ring (2) is screwed to the receiver ring (28) and extends over the bearing collar (27) of the cover (25), and the bearing collar (27) of the cover (25) is supported on the receiver ring (28) and is freely rotatable in a receiver formed by the fastening ring (2) and the receiver ring (28).

11. In a whirlpool bathtub in accordance with claim 10, wherein the housing ring (3) is connected, fixed against relative rotation, to the separate adjustment part (4).

12. In a whirlpool bathtub in accordance with claim 11, wherein the cover (25) is screwed with an interior thread to an exterior thread of the housing ring (3), and the cover (25) and the housing ring (3) form a receptacle in which the nozzle screen (5) and the separate adjustment part (4) are maintained clamped and secure against relative rotation.

13. In a whirlpool bathtub in accordance with claim 12, wherein the housing ring (3) has an inner receptacle, the diameter of which is larger than the outer diameter of an impeller wheel (6).

14. In a whirlpool bathtub in accordance with claim 1, wherein the pump chamber (P) widens in a direction towards the tub interior, and said at least one return conduit (K) is directed towards the tub bottom and extends parallel to the tub wall (1).

15. In a whirlpool bathtub in accordance with claim 1, wherein the rotary movement of the separate adjustment part (4) on the housing base part (23) is limited such that, in an end position, the pump chamber (P) is completely emptied through said at least one return conduit (K) towards the tub interior.

16. In a whirlpool bathtub in accordance with claim 1, wherein the separate adjustment part (4) is connected, fixed against relative rotation, to the nozzle screen (5) and is rotated together with it, and the nozzle screen (5) forms a cutout in the area of said at least one return conduit (K).

17. In a whirlpool bathtub in accordance with claim 1, wherein the separate adjustment part (4) and the nozzle screen (5) are connected, fixed against relative rotation, to a cover (25) having a bearing collar (27), which is maintained by a fastening ring (2) freely rotatable in a receiver ring (28) fixed in the opening (22) of the tub wall (1), and the cover (25) forms a cut out in the area of said at least one return conduit.

18. In a whirlpool bathtub in accordance with claim 17, wherein the cover (5) is closed in front of the centered aspiration opening (24) of the nozzle screen (5) and forms a plurality of radially oriented slits (26) outside of said closed area.

19. In a whirlpool bathtub in accordance with claim 17, wherein the fastening ring (2) is screwed to the receiver ring (28) and extends over the bearing collar (27) of the cover (25), and the bearing collar (27) of the cover (25) is supported on the receiver ring (28) and is freely rotatable in a receptacle formed by the fastening ring (2) and the receiver ring (28).

20. In a whirlpool bathtub in accordance with claim 1, wherein a housing ring (3) is disposed between the separate adjustment part (4) and the housing base part (23), said housing ring (3) connected, fixed against relative rotation, to the separate adjustment part (4) and rotatably supported by a plurality of seal rings (12, 13) on a receiver ring (28), and the housing base part (23) is inserted into the receiver ring (28) and maintained therein by a screw ring (10).

21. In a whirlpool bathtub in accordance with claim 20, wherein the housing ring (3) defines an annular groove (29) facing the receiver ring (28), which is bordered by the seal rings (12, 13), an air supply line (15) disposed on the receiver ring (28) terminates in the annular groove (29), and the annular groove (29) makes a transition into an outlet opening (30) in the area of said at least one return conduit (K).

22. In a whirlpool bathtub in accordance with claim 20, wherein the housing ring (3) is connected, fixed against relative rotation, to the separate adjustment part (4).

23. In a whirlpool bathtub in accordance with claim 20, wherein a cover (25) is screwed with an interior thread to an exterior thread of the housing ring (3), and the cover (25) and the housing ring (3) form a receptacle in which the nozzle screen (5) and the separate adjustment part (4) are maintained clamped and secure against relative rotation.

24. In a whirlpool bathtub in accordance with claim 20, wherein the housing ring (3) has an inner receptacle, the diameter of which is larger than the outer diameter of the impeller wheel (6).

* * * * *